United States Patent [19]

Helms

[11] 4,360,121

[45] Nov. 23, 1982

[54] EASY-OPEN LID CLOSURE ARRANGEMENT

[75] Inventor: Charles R. Helms, Malvern, Pa.

[73] Assignee: Container Corporation of America, Chicago, Ill.

[21] Appl. No.: 248,294

[22] Filed: Mar. 27, 1981

[51] Int. Cl.[3] ..... B65D 17/34

[52] U.S. Cl. ..... 220/270; 220/260; 229/43

[58] Field of Search ..... 220/267–270, 220/277, 260; 229/43

[56] References Cited

U.S. PATENT DOCUMENTS 3,397,814 8/1968 Zackheim ..... 220/306

4,211,336 7/1980 Helms ..... 220/270

*Primary Examiner*—George T. Hall

*Attorney, Agent, or Firm*—R. W. Carpenter; Davis Chin

[57] ABSTRACT

An easy-open closure arrangement for a composite plastic and paperboard lid which includes a pull tab for forcing a portion of the paperboard away from the plastic rim to permit complete detachment and removal of the central paperboard panel from the outer plastic rim.

5 Claims, 6 Drawing Figures

EASY-OPEN LID CLOSURE ARRANGEMENT

BACKGROUND OF THE INVENTION

1. Field of the Invention

This invention relate generally to composite plastic and paperboard lids and, more particularly, to an easy-open closure arrangement for same.

2. Description of the Prior Art

A state of the art search directed to the subject matter of this application uncovered the following U.S. Pat. Nos: Re. 27,611; 496,209; 3,159,303; 3,159,304; 3,187,930; 3,200,985; 3,239,112; 3,251,503; 3,257,022; 3,281,007; 3,282,477; 3,300,081; 3,314,569; 3,335,899; 3,407,957; 3,415,404; 3,415,412; 3,419,181; 3,434,620; 3,458,080; 3,459,315; 3,499,52; 3,532,248; 3,624,789; 3,661,306; 3,836,039; 3,927,795; 3,981,412; 4,087,018; Austrian Pat. No. 277860; Swiss Pat. No. 453117; Swiss Pat. No. 463986.

None of the prior art patents uncovered in the search disclosed a composite plastic and paperboard lid having a pivoted tab for separating a portion of the paperboard from the plastic to permit complete detachment and removal thereof.

SUMMARY OF THE INVENTION

It is an object of the invention to provide an easy-open closure arrangement for a composite plastic and paperboard lid of a container.

A more specific object of the invention is to provide, in a composite lid having a plastic rim and a paperboard central panel bonded thereto, a tab which may be used to detach a portion of the central panel from the rim to permit complete separation and removal thereof.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENTS

Figure 1:
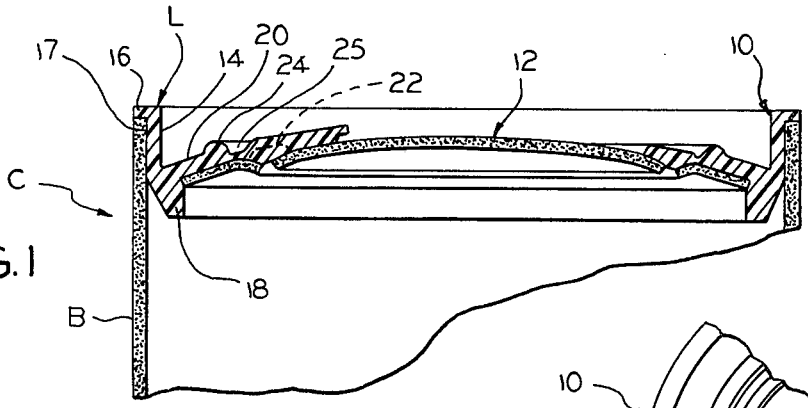
FIG. 1 is a fragmentary, transverse, vertical section of a container and lid embodying features of the invention.

Referring now to the drawings for a better understanding of the invention, it will be seen that the container, indicated generally at C in FIG. 1, is a composite can or carton which includes a tubular body wall B to which is attached a composite plastic and paperboard lid indicated generally at L.

The lid is of the general type and construction disclosed in U.S. Pat. No. 3,397,814. In this type of construction the paperboard portion of the lid is inserted into a mold and then plastic is inserted to form the rim of the lid and at the same time bond the rim of the lid to a marginal surface of the paperboard panel insert. Also, if desired the plastic rim of the lid may also be joined to the body wall of the container in the same manner.

Figure 4:
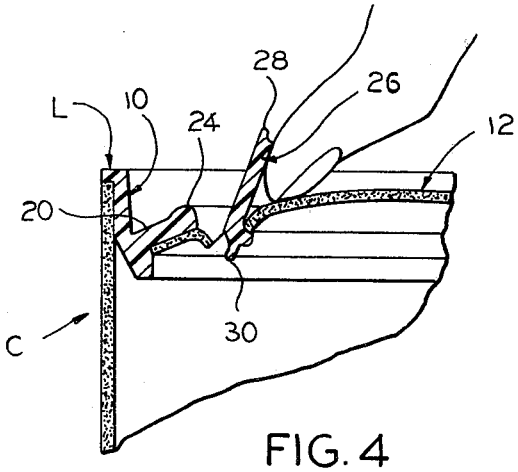
FIGS. 4 and 5 are views similar to FIG. 1 but showing the mannner in which the invention is employed to provide a dispensing opening in the container lid.
Figure 5:
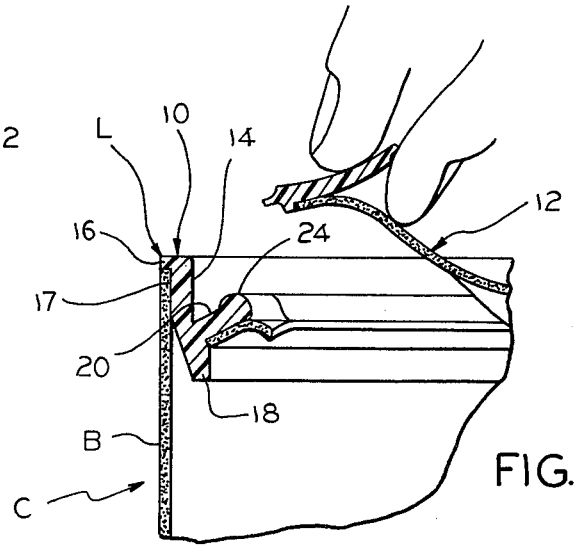

Referring now to FIGS. 1 and 4, it will be seen that the lid L includes an annular molded plastic rim 10 and a relatively thin round central panel 12 formed of paperboard and having its marginal portion secured to the rim 10 as previously described. Panel 12 is provided with an annular groove 13 located radially inward a short distance from its outer edge.

Rim 10 includes a generally vertically disposed skirt or outer side flange 14 having at its upper or outer edge a radially outwardly extending shoulder or lip 16 which forms with the main portion of flange 14 a channel or recess 17 adapted to receive an end portion of container body wall B.

Rim 10 includes a downwardly extending lower section 18 formed integrally with the side flange 14 and also includes a radially inwardly extending generally horizontally disposed annular inner end flange 20.

At the inner edge of end flange 20 there are formed a pair of integral, inner and outer beads or reinforcing rings 22 and 24, respectively, which are separated from each other by a relatively narrow, thin area 25 which is the line of weakness or separation, as hereinafter described.

When the central panel is separated from the rim, outer bead 24 serves as a reinforcing member for the edge of the rim 10, and inner bead 22 serves as a reinforcing member for the central panel 12. That is, bead 22 prevents panel 12 from tearing when the panel is removed in a manner hereinafter described.

Also, as tab 26 is mounted on bead 22, bead 22 serves as a fulcum for the pull tab 26.

Pull tab 26 includes a rear or handle portion 28 and an integral front or nose portion 30.

Figure 2:
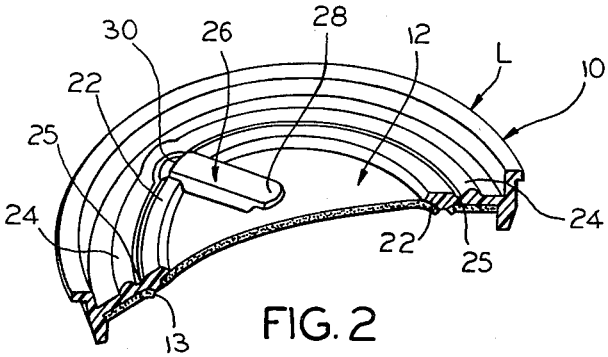
FIG. 2 is a fragmentary perspective view of a portion of the structure illustrated in FIG. 1.
Figure 3:
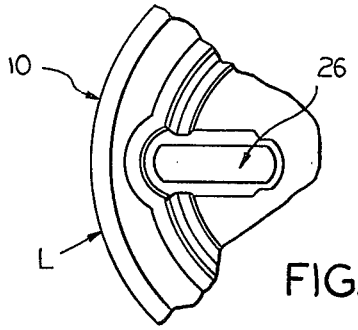
FIG. 3 is a fragmentary plan view of a portion of the structure of FIG. 2.

As best seen in FIGS. 2 and 3 the beads 22 and 24 are offset radially outward a slight distance where the pull tab is located to accommodate the nose of the pull tab and help provide better leverage.

In order to dispense from the container, the rear portion 30 of the pull tab is lifted causing the tab to fulcum about bead 22 so that the front or nose portion of the tab is depressed and causes the edge of panel 12 to be pushed downwardly and detached from rim 10. At this point, the handle portion 30 of the tab is pulled up further to completely detach and remove central panel 12 from rim 10 in a manual somewhat similar to that of metal can easy open ends.

Figure 6:
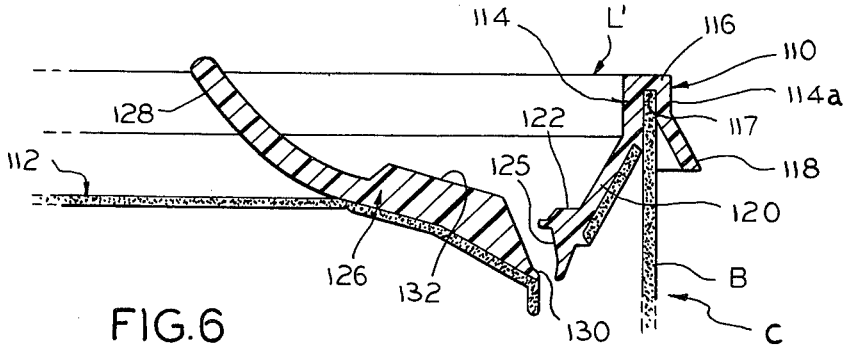
FIG. 6 is a view similar to FIG. 4, but illustrating a modified form of the invention.

Now turning to FIG. 6, it will be seen that a slightly modified form of the invention is illustrated.

In this embodiment those elements which correspond to similar elements of the previously described embodiment have been designated by corresponding or similar numerals.

In the embodiment of FIG. 6 the outer flange arrangeent of the rim 110 an additional outer section **114*a* which, with inner section 114 forms a channel 117** for receiving the end of a container body wall B.

The primary difference, however, is that pull tab 26 is provided with a central, vertically disposed longitudinally extending reinforcing plate or flange 130 which serves to keep the pull tab from bending in the middle, otherwise this arrangement functions in the same way as the structure of the previously described embodiment.

I claim:

1. An easy-open closure arrangement for a composite plastic and paperboard lid, comprising:

(a) an annular molded plastic rim including an outer, side flange, adapted for attachment to a wall of a container body, and an integral, inner, end flange extending radially radially inward therefrom:

(b) a relatively thin paperboard central panel having a marginal portion of its upper surface bonded to a lower surface of said rim end flange; and (c) said rim including an integral pull tab being pivotally mounted with respect to said rim, said pull tab having a handle portion and a nose portion, said nose portion being engageable with a portion of said central panel, said handle portion of said pull tab being lifted causing said nose portion of said tab to depress downwardly a portion of said central panel to force it away from said rim end flange and permit the complete detachment and removal of said central panel from said rim.

2. An easy-open closure arrangement according to claim 1, wherein said tab is mounted on an annular bead of said rim inner flange.

3. An easy-open closure arrangement according to claim 1, wherein said rim outer side flange is molded to said container side wall.

4. An easy-open closure arrangement accordng to claim 1, wherein said rim inner end flange is molded to said central panel.

5. An easy-open closure arrangement according to claim 1, wherein said rim end flange includes adjacent the inner edge thereof a pair of integral annular areas of increased cross-section separated by a narrow area of reduced cross-section which area serves as a line of separation.

* * * * *